US005654594A

United States Patent [19]

Bjornsen, III et al.

[11] Patent Number: 5,654,594

[45] Date of Patent: Aug. 5, 1997

[54] ERGONOMIC ELECTRICAL CURRENT SWITCHING SYSTEMS

[75] Inventors: Bernie E. Bjornsen, III; Peter Hauk, both of Huntington Beach; John W. Matthews, Corona del Mar, all of Calif.

[73] Assignee: Laser Products Ltd., Fountain Valley, Calif.

[21] Appl. No.: 607,696

[22] Filed: Feb. 27, 1996

[51] Int. Cl.[6] ..... H01H 71/50

[52] U.S. Cl. ..... 307/115; 200/5 R; 200/61.85; 200/293.1; 200/512; 42/70.01; 42/71.01; 307/116

[58] Field of Search ..... 307/116, 115; 200/5 R, 5 A, 512, 513, 61.41, 61.43, 85, 61.57, 293.1; 42/66, 70.01, 71.01

[56] References Cited

U.S. PATENT DOCUMENTS

| | | | |
|---|---|---|---|
| 3,700,836 | 10/1972 | Rackson | 200/52 |
| 3,739,167 | 6/1973 | Avery | 362/157 |
| 4,152,754 | 5/1979 | deFilippis et al. | 362/113 |
| 4,433,217 | 2/1984 | Griffith | 200/5 R |
| 4,517,424 | 5/1985 | Kroczynski | 200/52 R |
| 4,542,447 | 9/1985 | Quackenbush | 362/183 |
| 5,245,144 | 9/1993 | Stammen | 200/61.85 |
| 5,510,589 | 4/1996 | Arnal | 200/522 |
| 5,561,278 | 10/1996 | Rutten | 200/5 A |

*Primary Examiner*—William M. Shoop, Jr.
*Assistant Examiner*—Albert W. Paladini
*Attorney, Agent, or Firm*—Benoit Law Corporation

[57] ABSTRACT

In order to enable switching electric currents with a part of a human hand for an accessory of a firearm having a firearm handle, that firearm handle is complemented with an arcuate member, which is formed in similarity to a portion of that human hand in a clenched position at the mentioned part. An electric switching device on that arcuate member is at a location corresponding to the mentioned part of the human hand in its clenched position. The arcuate member may be provided with a mount. A bidirectional electric circuit extends along or through the arcuate member and may extend along or through the mount to and from the electric switching device.

33 Claims, 1 Drawing Sheet

ERGONOMIC ELECTRICAL CURRENT SWITCHING SYSTEMS

FIELD OF THE INVENTION

The invention resides in ergonomic electric current switching systems.

BACKGROUND

The need for electric switching devices is ever expanding. By way of example, consider the need to switch electrical accessories, such as luminous aim assisting devices on hand guns. In that case, tape switches have been provided within the reach of the "gun hand" of the user.

There are, however, many instances where more ergonomic electric switches would be useful.

SUMMARY OF THE INVENTION

It is a general object of the invention to provide improved ergonomic electric current switching systems.

It is a related object of the invention to provide electric current switching systems having an active part shaped in similarity to a part of a clenched human hand.

Other objects of the invention will become apparent in the further course of this disclosure.

From a first aspect thereof, the invention resides in a method of switching electric current with a part of a human hand for an accessory of a firearm having a firearm handle and, more specifically, resides in the improvement comprising, in combination, complementing said firearm handle with an arcuate member in similarity to a portion of that human hand in a clenched position at the mentioned part, providing an electric switching device on that arcuate member at a location corresponding to the mentioned part of the human hand in its clenched position, and forming a bidirectional electric circuit along the arcuate member to and from the electric switching device.

From a related aspect thereof, the invention resides in apparatus for switching electric current with a part of a human hand for an accessory of a firearm having a firearm handle, and, more specifically, resides in the improvement comprising, in combination, an arcuate member bent in similarity to a portion of that human hand in a clenched position at the mentioned part and complementing said firearm handle, an electric switching device on that arcuate member at a location corresponding to the mentioned part of the human hand in its clenched position, and a bidirectional electric circuit along the arcuate member to and from the electric switching device.

From a related aspect thereof, the invention resides in apparatus for switching electric current with a part of a human hand for an accessory of a firearm having a firearm handle, and, more specifically, resides in the improvement comprising, in combination, a laminate structure including a first electrically conductive layer and a second electrically conductive layer electrically insulated from each other and bent into an arcuate member in similarity to a portion of that human hand in a clenched position at the mentioned part and complementing said firearm handle, and an electric switching device on the arcuate member at a location corresponding to the mentioned part of the human hand in its clenched position, and a bidirectional electric circuit through the first and second electrically conductive layers and electric switching device.

BRIEF DESCRIPTION OF THE DRAWINGS

The subject invention and its various aspects and objects will become more readily apparent from the following detailed description of preferred embodiments thereof, illustrated by way of example in the accompanying drawings which also constitute a written description of the invention, wherein like reference numerals designate like or equivalent parts, and in which.

DESCRIPTION OF PREFERRED EMBODIMENTS

The accompanying drawings illustrate methods and apparatus for switching electric current with part of a human hand according to embodiments of the invention and are of themselves written descriptions thereof. An arrow 10 between FIGS. 1 and 2 indicates how the enlarged view of FIG. 2 may relate to the view of FIG. 1.

Figure 1:
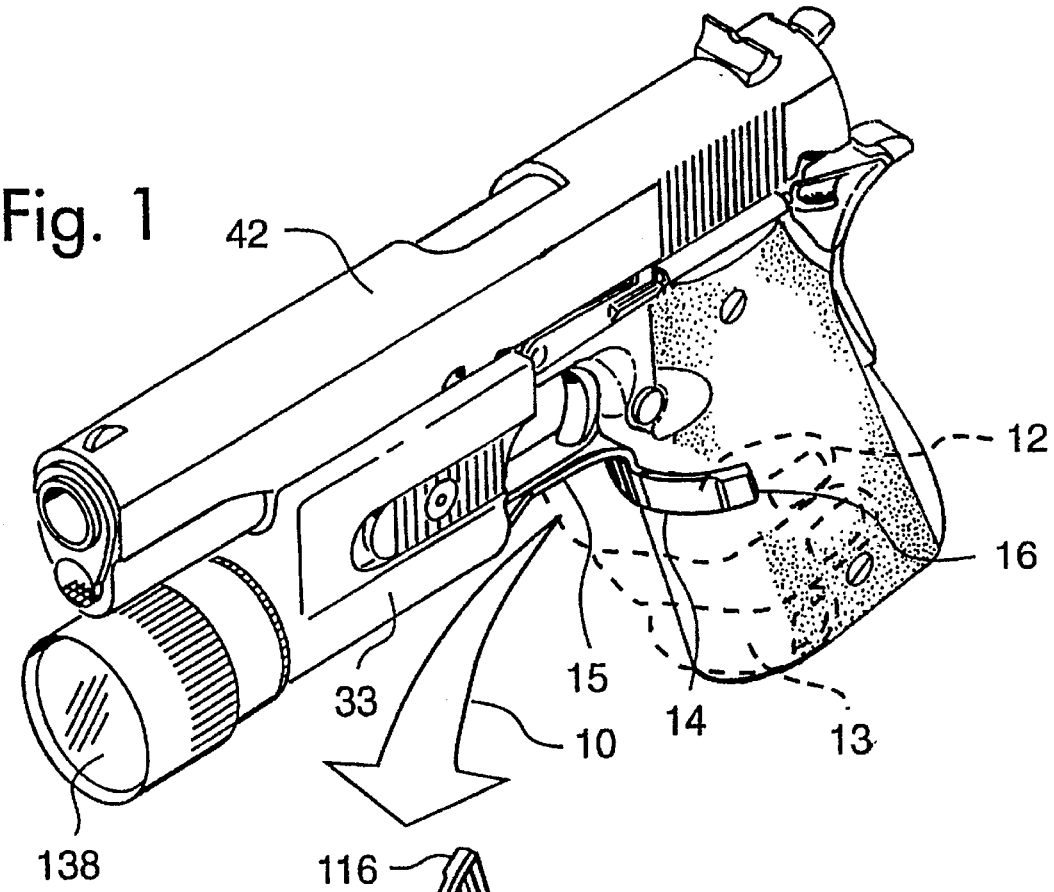
FIG. 1 is a perspective view of a hand weapon with target illuminator and a switching apparatus according to an embodiment of the invention.

FIG. 1 in particular shows methods and apparatus for switching electric current with a finger 12 or another part of a human hand 13 shown in dotted outline.

The invention forms an arcuate member 14 in similarity to a portion of the human hand 13 in a clenched position, such as shown in FIG. 1, at the finger 12 or other part with which the electric current is switched.

The illustrated embodiment also forms a mount 15 for the arcuate member 14. According to an illustrated embodiment of the invention, the arcuate member 14 preferably is suspended from mount 15 at an apex of that arcuate member.

An electric switching device 16 is provided on the arcuate member 14 at a location corresponding to the part 12 of the human hand 13 in its clenched position, such as shown in FIG. 1.

A bidirectional electric circuit 18 is formed along the arcuate member 14 and the mount 15 to and from the electric switching device 16.

According to an embodiment of the invention, at least part of the bidirectional electric circuit 18 is formed by composing the mount 15 of at least partially coextending electrically conductive layers or other electrical conductors 20 and 21 electrically insulated from each other. Within the scope of that embodiment, both the mount 15 and the arcuate member 14 may be composed of at least partially coextending electrically conductive layers or other electrical conductors 20 and 21 electrically insulated from each other, such as by a thin layer or coating of insulating material 22 between or on one or both of the electrically conductive layers or conductors.

According to a preferred embodiment of the invention, the mount 15 is formed of or is a laminate structure 118 including an electrically insulating layer 22, a first electrically conductive layer 20 on one side of the insulating layer, and a second electrically conductive layer 21 on an opposite side of the insulating layer, and the bidirectional electric circuit 18 is provided or extends through the first and second electrically conductive layers 20 and 21.

Within the scope of that embodiment, both the arcuate member 14 and its mount 15 may be, or may be formed of, a laminate, such as the laminate structure 118.

The electrical conductors or electrically conductive layers 20 and 21 may be formed into a bifurcated end portion 23 of the mount 15 opposite the arcuate member 14.

The electric switching device 16 may be formed of or include the electrical conductors or electrically conductive layers 20 and 21. By way of example, the insulating layer 22 between the electrically conductive layers 20 and 21 seen in FIG. 4 may be omitted at the switching device 16 seen in FIG. 3. Instead, marginal electrically insulating spacers 25 and 26 may be provided at the switching device 16 between the electrically conductive layers 20 and 21.

Figure 3:
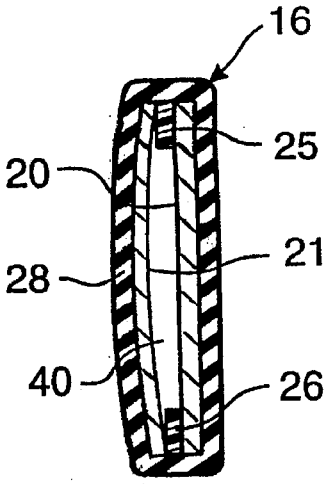
FIG. 3 is a section on an enlarged scale taken on the line 3—3 in FIG. 2 of an electric switching device according to an embodiment of the invention.
Figure 4:
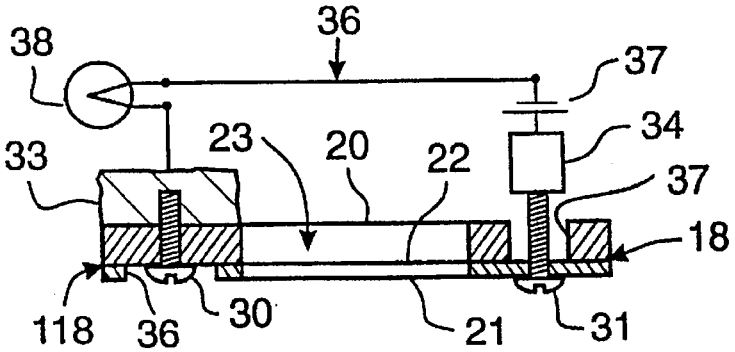
FIG. 4 is a section on an enlarged scale taken on the line 4—4 in FIG. 2 of an electric terminal structure according to an embodiment of the invention.

In this or any other manner within the scope of the invention, the electrically conductive layers 20 and 21 are spaced from each other in the region of the switching device 16. One of these layers, such as the layer 21, may be biased relative to the other layer and may be relatively moveable relative to the stationary layer 20. By way of example, the layer 21 may be made of resilient electrically conductive material curved away from the relatively stationary layer 20, such as seen in FIG. 3.

The assembly of switching device 16 may be completed by an electrically insulating elastomeric enclosure 28 of the relatively stationary and relatively moveable electrically conductive layers 20 and 21 and their intervening insulating spacers 25 and 26.

According to the illustrated embodiment of the invention, the bifurcated end 23 may accommodate fasteners 30 and 31 for attaching the mount to a base or other article 33 and to an electric terminal 34, respectively.

In particular, the electrically conductive layer 21 may have a clearance 36 for a fastener 30 that grounds the conductive layer 20 to the base 33. Conversely, that conductive layer 20 may have a second clearance 37 for a fastener 31 that electrically connects the other conductive layer 21 to a terminal 34 without contacting the conductive layer 20.

Figure 2:
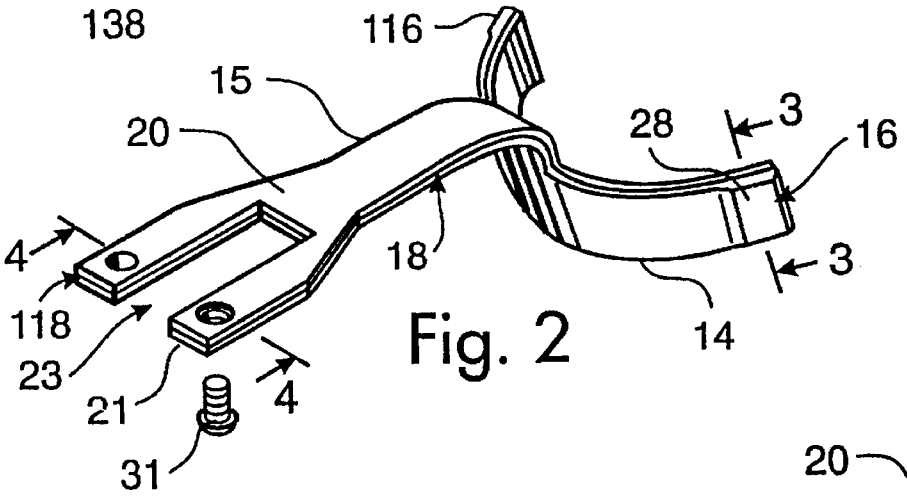
FIG. 2 is an enlarged perspective view of a switching apparatus such as shown in FIG. 1.

It may be seen, such as from FIG. 3 when viewed in conjunction with FIGS. 1 and 2 that a laminate structure including first electrically conductive layer 20 and a second electrically conductive layer 21 electrically insulated from each other may be bent into the desired arcuate member 14 in similarity to a portion of the above mentioned human hand 13 in a clenched position at part 12. Electric switching device 16 and/or 116 is on that arcuate member at a location corresponding to the desired part of the human hand in its clenched position.

The electric switching device may be formed of or include these electrically conductive layers 20 and 21, such as shown in FIG. 3 and described above. The insulating spacers 25 and 26 are between the electrically conductive layers 20 and 21 at the electric switching device 16 or 116.

The mount 15 for the arcuate member 14 preferably includes the laminate structure 18 having an electrically insulating layer 22 between the first and second electrically conductive layers 20 and 21 forming a bidirectional electric circuit through the mount, the arcuate member and its electric switching device.

An electric circuit 36 including a series-connected electric power source, such as a battery 37, and a load, such as an electric lamp 38, is connected between the base 33 and terminal 34.

In the absence of actuation of the switching device 16, the insulating layer 22 and spacers 25 and 26 prevent electric current flow in the circuit 36. However, if the part of the human hand or finger 12 seen in FIG. 1 depresses the inherently biased electrically conductive resilient layer 21 through the free space 40 into contact with the stationary layer 20, then the circuit 36 is completed through closure of the .switching device 16, and electric current can flow from the source 37 through the load 38 for energization thereof, such as for emission of a light beam, until the finger 12 lets the resilient layer 21 go and snap back to its spaced position seen in FIG. 3.

Within the broad scope of the invention, the electric circuit 18 alternatively may be formed by wiring, such as by extending one or more wires from the switching device 16 on the arcuate member 14 to a source of electric current and the electric load to be switched, or to the forked end 23 for that matter. In terms of FIG. 2 part of the electric conductor 21 along the mount 15 may be formed by a cable or wire. However, the illustrated laminate layer embodiment is presently preferred.

The electric switching device or system may be provided as distinct electric switches 16 and 116 for actuation by different parts of human hands. By way of example, a second switching device 116, spaced on the arcuate member 14, may have essentially the same structure as the switching device 16 shown in FIGS. 1 to 3.

For instance, a right-handed person may prefer the switching device 16 shown in FIGS. 1 to 3, while a left-handed person may give preference to using the second switching device 116 seen in FIG. 2. Other preferences may arise from different sizes of different persons' hands which may dictate placing further switches of the type of switch 16 at various locations between the switches 16 and 116 shown in FIG. 2.

In this respect, FIG. 1 suggests actuation of the switch 16 with the upper digit at the fingertip of the right middle finger. Use of the middle finger is a typical example, since the index finger customarily is busy as the "trigger finger." Of course, if the person is left-handed, he or she may prefer using the middle finger of the left hand for actuating the alternative switch 116.

Other weapon users may prefer to use the second digit of one of the middle fingers, or may prefer to use another finger or other part of their hand altogether to actuate a switch on the arcuate members 14; which would be another reason for placing different switches at various locations along such arcuate member.

In practice, the manufacturer may provide the arcuate member 14 with several such switches 16, 116, etc. However, at least in the application illustrated in FIG. 1, only one of such several switches is then enabled for actuation at any one time. A selector may be provided between the conductor 21 along the mount 15 and the various switches, so as to enable the user to select which switch he or she wants to actuate depending on the chirality or size of his or her hand, or the switches which the particular user may not want to actuate may be blocked such as by keeping the electrically conductive layers or switch members 20 and 21 apart by a wedge or shim inserted in the hollow space 40 between these electric conductors or conductive layers 20 and 21 in each switch (such as in switch 116), except for the switch (such as switch 16) that the user desires to use in controlling energization of the load 38.

By way of example, the base structure 33 may be a housing for a battery 37, and the electric lamp 38 may be part of a target illuminating accessory 138 of a firearm, such as a hand gun 42. That hand gun may have a handle or pistol grip that is ergonomically shaped and that is complemented by the ergonomically shaped arcuate member 14 according to the invention.

While being useful in this respect, the invention, however, is not limited to such an application. Rather, this extensive disclosure will render apparent or suggest to those skilled in the art various modifications and variations within the spirit and scope of the invention.

We claim:

1. In a method of switching electric current with a part of a human hand for an accessory of a firearm having a firearm handle, the improvement comprising in combination:

complementing said firearm handle with an arcuate member bent in similarity to a portion of said human hand in a clenched position at said part;

providing an electric switching device on said arcuate member at a location corresponding to said part of the human hand in said clenched position; and forming a bidirectional electric circuit along said arcuate member and said mount to and from said electric switching device.

2. A method as in claim 1, wherein:

said electric switching device is provided with distinct electric switches for actuation by different parts of human hands.

3. A method as in claim 1, including:

forming a mount for said arcuate member.

4. A method as in claim 3, including:

suspending said arcuate member from said mount at an apex of said arcuate member.

5. A method as in claim 3, including:

providing said mount with a bifurcated end opposite said arcuate member.

6. A method as in claim 3, including:

extending said bidirectional electric circuit from said arcuate member along said mount.

7. A method as in claim 3, including:

extending said bidirectional electric circuit at least partially through said mount.

8. A method as in claim 3, including:

extending said bidirectional electric circuit at least partially through said mount and through said arcuate member.

9. A method as in claim 3, including:

forming at least part of said bidirectional electric circuit by composing said mount of at least partially coextending electrical conductors electrically insulated from each other.

10. A method as in claim 9, including:

forming said electrical conductors into a bifurcated end portion of said mount opposite said arcuate member.

11. A method as in claim 3, including:

forming at least part of said bidirectional electric circuit by composing said mount and said arcuate member of at least partially coextending electrical conductors electrically insulated from each other.

12. A method as in claim 11, including:

forming said electric switching device from said electrical conductors.

13. A method as in claim 3, including:

forming said mount of a laminate structure including an electrically insulating layer, a first electrically conductive layer on one side of said insulating layer, and a second electrically conductive layer on an opposite side of said insulating layer; and providing said bidirectional electric circuit through said first and second electrically conductive layers.

14. A method as in claim 3, including:

forming said mount and said arcuate member of a laminate structure including an electrically insulating layer, a first electrically conductive layer on one side of said insulating layer, and a second electrically conductive layer on an opposite side of said insulating layer; and providing said bidirectional electric circuit through said first and second electrically conductive layers.

15. A method as in claim 14, including:

forming said electric switching device from said electrically conductive layers.

16. In apparatus for switching electric current with a part of a human hand for an accessory of a firearm having a firearm handle, the improvement comprising in combination:

an arcuate member bent in similarity to a portion of said human hand in a clenched position at said part and complementing said firearm handle;

an electric switching device on said arcuate member at a location corresponding to said part of the human hand in said clenched position; and a bidirectional electric circuit along said arcuate member to and from said electric switching device.

17. Apparatus as in claim 16, wherein:

said electric switching device comprises distinct electric switches at different locations on said arcuate member.

18. Apparatus as in claim 16, including:

a mount for said arcuate member.

19. Apparatus as in claim 18, including:

said mount and said arcuate member interconnected at an apex of said arcuate member.

20. Apparatus as in claim 18, wherein:

said mount has a bifurcated end opposite said arcuate member.

21. Apparatus as in claim 18, wherein:

said bidirectional electric circuit extends at least partially through said mount.

22. Apparatus as in claim 18, including:

an extension of said bidirectional electric circuit from said arcuate member along said mount.

23. Apparatus as in claim 18, wherein:

said bidirectional electric circuit extends at least partially through said mount and through said arcuate member.

24. Apparatus as in claim 18, wherein:

said mount comprises at least partially coextending electrical conductors electrically insulated from each other and forming at least part of said bidirectional electric circuit.

25. Apparatus as in claim 24, wherein:

said electrical conductors include a bifurcated end portion of said mount opposite said arcuate member.

26. Apparatus as in claim 18, wherein:

said mount and said arcuate member comprise at least partially coextending electrical conductors electrically insulated from each other and forming at least part of said bidirectional electric circuit.

27. Apparatus as in claim 26, wherein:

said electric switching device includes said electrical conductors.

28. In apparatus for switching electric current with a part of a human hand for an accessory of a firearm having a firearm handle, the improvement comprising in combination:

a laminate structure including a first electrically conductive layer and a second electrically conductive layer insulated from each other and bent into an arcuate member in similarity to a portion of said human hand in a clenched position at said part and complementing said firearm handle; and an electric switching device on said arcuate member at a location corresponding to said part of the human hand in its clenched position.

29. Apparatus as in claim 28, including:

a mount for said arcuate member including said laminate structure having an electrically insulating layer between said first and second electrically conductive layers; and a bidirectional electric circuit through said first and second electrically conductive layers and electric switching device.

30. Apparatus as in claim 28, wherein:

said electric switching device includes said electrically conductive layers.

31. Apparatus as in claim 30, including:

insulating spacers between said electrically conductive layers at said electric switching device.

32. Apparatus as in claim 30, including:

one of said electrically conductive layers biased relative to the other of said electrically conductive layers.

33. Apparatus as in claim 30, including:

an elastomeric enclosure of said electrically conductive layers.

* * * * *